US009835105B2

(12) United States Patent
Yanoto

(10) Patent No.: US 9,835,105 B2
(45) Date of Patent: Dec. 5, 2017

(54) FUEL INJECTION CONTROL DEVICE FOR INTERNAL COMBUSTION ENGINE

(71) Applicant: DENSO CORPORATION, Kariya, Aichi-pref. (JP)

(72) Inventor: Keisuke Yanoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/314,121

(22) PCT Filed: Apr. 27, 2015

(86) PCT No.: PCT/JP2015/002272
§ 371 (c)(1),
(2) Date: Nov. 28, 2016

(87) PCT Pub. No.: WO2015/182042
PCT Pub. Date: Dec. 3, 2015

(65) Prior Publication Data

US 2017/0191437 A1 Jul. 6, 2017

(30) Foreign Application Priority Data

May 30, 2014 (JP) ..... 2014-112581

(51) Int. Cl.
*F02M 1/00* (2006.01)
*F02D 41/20* (2006.01)

(52) U.S. Cl.
CPC ..... *F02D 41/20* (2013.01); *F02D 2041/2003* (2013.01); *F02D 2041/2034* (2013.01); *F02D 2041/2058* (2013.01)

(58) Field of Classification Search
CPC .... F02D 41/30; F02D 2041/389; F02D 41/20; F02D 1/16; F02D 2200/0618; F02D 41/34; F02D 41/345; F02M 51/0603; F02M 51/061
USPC ..... 123/445, 446, 472, 477–480, 490; 701/103–107; 239/585.1; 361/153–155
See application file for complete search history.

(56) References Cited

U.S. PATENT DOCUMENTS 5,381,297 A * 1/1995 Weber ..... F02D 41/20 361/153
5,482,022 A * 1/1996 Aoki ..... F02D 41/065 123/479
6,173,700 B1 * 1/2001 Yamashita ..... F02D 41/20 123/490

(Continued)

*Primary Examiner* — John Kwon
(74) *Attorney, Agent, or Firm* — Nixon & Vanderhye PC

(57) ABSTRACT

An ECU, which applies a predetermined high voltage for valve-opening operation and subsequently applies a predetermined low voltage to maintain the valve-opening and thus energizes a fuel injector for fuel injection by the fuel injector, includes a current detection section that detects an energizing current flowing through the fuel injector, a drive IC that, after start of energization of the fuel injector, when a detection current detected by the current detection section arrives at a beforehand determined target peak value, switches the voltage applied to the fuel injector from the high voltage to the low voltage, and a microcomputer that calculates a slope of change in current in the detection current while the high voltage is applied to the fuel injector, and performs correction processing to correct shift of a peak point of an actual current flowing through the fuel injector based on the slope of change in current.

8 Claims, 10 Drawing Sheets

(56) References Cited

U.S. PATENT DOCUMENTS

| | | | | |
|---|---|---|---|---|
| 7,034,437 | B2 * | 4/2006 | Fukagawa | F02D 41/2096 310/316.03 |
| 9,261,038 | B2 * | 2/2016 | Nishida | F02D 41/20 |
| 2015/0144109 | A1 | 5/2015 | Mukaihara et al. | |

* cited by examiner

FUEL INJECTION CONTROL DEVICE FOR INTERNAL COMBUSTION ENGINE

This application is the U.S. national phase of International Application No. PCT/JP2015/002272 filed on Apr. 27, 2015 which designated the U.S. and claims priority to Japanese Patent Application No. 2014-112581 filed on May 30, 2014, the entire contents of each of which are incorporated herein by reference.

CROSS REFERENCE TO RELATED APPLICATION

This application is based on Japanese Patent Application No. 2014-112581 filed on May 30, 2014, the disclosure of which is incorporated herein by reference.

TECHNICAL FIELD

The present disclosure relates to a fuel injection control device for an internal combustion engine.

BACKGROUND ART

For example, an electromagnetic-solenoid fuel injector is known as a fuel injector that injects and supplies fuel into each cylinder of an internal combustion engine mounted in a vehicle. In this type of fuel injector, energization timing and energization time of a coil housed in a fuel injector body are controlled so that a needle is moved in a valve-opening direction to control fuel injection timing and fuel injection amount.

A method of driving a fuel injector has been provided, in which a coil-applied voltage is set to a high voltage early in valve opening, and is then switched to a low voltage. Such a technique improves valve-opening responsivity by applying the high voltage, and allows low-power drive of the fuel injector through subsequent switching to the low voltage. The high voltage is switched to the low voltage based on a detection current detected by a current detection circuit. That is, when the detection current is determined to arrive at a predetermined target peak value, the applied voltage is switched.

Since a machine difference variation exists in the fuel injection device, a variation probably occurs in an actual drive current, and the fuel injection amount concernedly varies due to such a variation in drive current. In Patent Literature 1, therefore, the amount of a machine difference variation in actual drive current is beforehand stored in a storage, and a target drive current is corrected based on the amount of the machine difference variation.

However, the machine difference variation is not constant between the fuel injection devices, and probably varies with the lapse of time.

A possible cause of a variation in fuel injection amount includes deviation in detection by a current detection circuit in addition to the variation in actual drive current in the fuel injector. In such a case, when it is designed that the applied voltage is switched from the high voltage to the low voltage based on the detection current detected by the current detection circuit as described above, voltage switching timing is shifted due to an error in the detection current. Specifically, shift of a peak point occurs in an actual current. Hence, shift of input energy to the fuel injector occurs, resulting in variations in valve-opening response characteristics of the fuel injector. This concernedly leads to excess and deficiency of the fuel injection amount.

PRIOR ART LITERATURES

Patent Literature

[Patent Literature 1] JP 2014-5740 A

SUMMARY OF INVENTION

In view of the above-described background art, an object of the disclosure is to provide a fuel injection device for an internal combustion engine, which achieves appropriate fuel injection control.

According to one embodiment of the disclosure, a fuel injection control device for an internal combustion engine is used in an internal combustion engine having a fuel injector that is driven to open a valve through energization. The fuel injection control device includes an injector drive section that applies a predetermined high voltage for valve-opening operation and subsequently applies a predetermined low voltage to maintain valve-opening, and thus energizes the fuel injector. The fuel injection control device further includes a current detection section that detects an energizing current flowing through the fuel injector; a voltage switching section that, after start of energization of the fuel injector, when a detection current detected by the current detection section arrives at a beforehand determined target peak value, switches the voltage applied to the fuel injector from the high voltage to the low voltage; and a peak shift correction section that calculates a slope of change in current for the detection current while the high voltage is applied to the fuel injector, and performs correction processing to correct shift of a peak point of an actual current flowing through the fuel injector based on the slope of change in current.

When an error is contained in a value of the energizing current detected by the current detection section, the peak point of the actual current through the fuel injector is shifted at application of the high voltage to the fuel injector. In such a case, since input energy to the fuel injector is shifted, valve-opening response characteristics are varied, which concernedly leads to excess and deficiency of the fuel injection amount. It is designed that while the high voltage is applied to the fuel injector, a slope of change in current is calculated for the detection current, and correction processing to correct shift of the peak point of the actual current through the fuel injector is performed based on the slope of change in current. Consequently, even if an error exists in detection by the current detection section, shift of input energy to the fuel injector can be suppressed, leading to improvement in accuracy of fuel injection control.

DESCRIPTION OF EMBODIMENTS (First Embodiment)

A first embodiment is now described with reference to drawings. The first embodiment is embodied as a control system that controls a gasoline engine for a vehicle.

Figure 1:
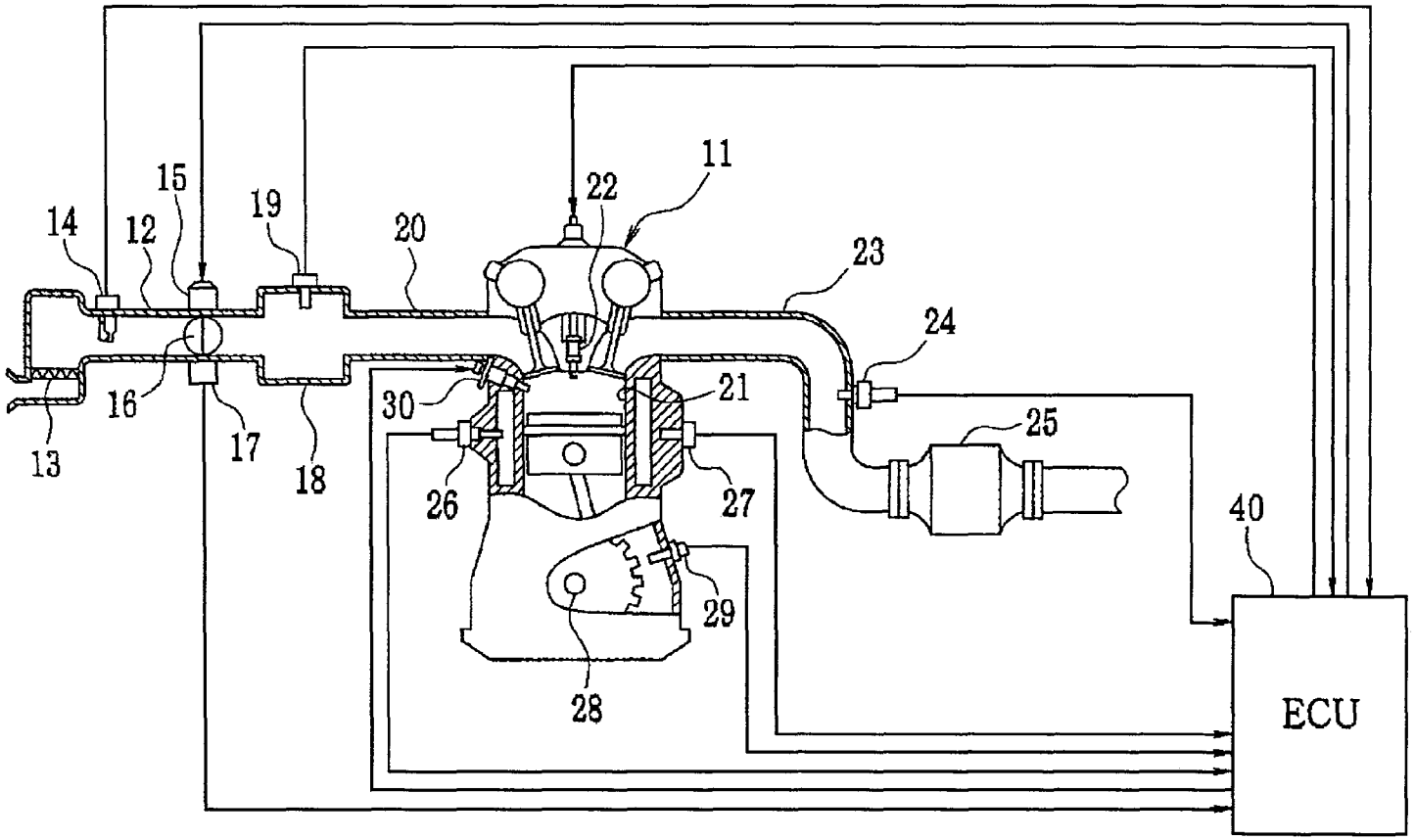
FIG. 1 is a schematic illustration of a configuration of an engine control system.

A schematic configuration of an engine control system is now described with reference to FIG. 1.

An air cleaner 13 is provided in a most upstream portion of an intake pipe 12 of an engine 11 as an in-cylinder injection type of multi-cylinder internal combustion engine, and an airflow meter 14 that detects intake air mass is provided on a downstream side of the air cleaner 13. A throttle valve 16 of which the degree of opening is regulated by a motor 15, and a throttle position sensor 17, which detects the degree of opening (throttle position) of the throttle valve 16, are provided on a downstream side of the airflow meter 14.

A surge tank 18 is provided on a downstream side of the throttle valve 16, and an intake pipe pressure sensor 19 that detects intake pipe pressure is provided in the surge tank 18. The surge tank 18 is connected to an intake manifold 20 that introduces air into each cylinder 21 of the engine 11, and an electromagnetic fuel injector 30 that directly injects fuel into each cylinder is mounted in the cylinder 21 of the engine 11. An ignition plug 22 is mounted in the cylinder head of the engine 11 for each cylinder 21, and an air-fuel mixture in the cylinder is ignited by spark discharge of the ignition plug 22 in the cylinder 21.

An exhaust gas sensor 24 (air-fuel ratio sensor, oxygen sensor) that detects an air-fuel ratio or rich/lean based on exhaust gas is provided in an exhaust pipe 23 of the engine 11, and a three-way catalyst 25 that cleans up exhaust gas is provided on a downstream side of the exhaust gas sensor 24.

A cooling-water temperature sensor 26 that detects cooling water temperature and a knock sensor 27 that detects knocking are mounted in a cylinder block of the engine 11. A crank angle sensor 29 that outputs a pulse signal every time a crank shaft 28 rotates by a predetermined crank angle is mounted on an outer circumferential side of the crank shaft 28, and a crank angle and engine rotation speed are detected based on a crank angle signal by the crank angle sensor 29.

Output of each of the sensors is received by ECU 40. The ECU 40 is an electronic control unit mainly including a microcomputer, and performs various kinds of control of an internal combustion engine with a detection signal from each sensor. The ECU 40 calculates the fuel injection amount in correspondence to an engine operation state to control fuel injection of the fuel injector 30, and controls ignition timing of the ignition plug 22.

Figure 2:
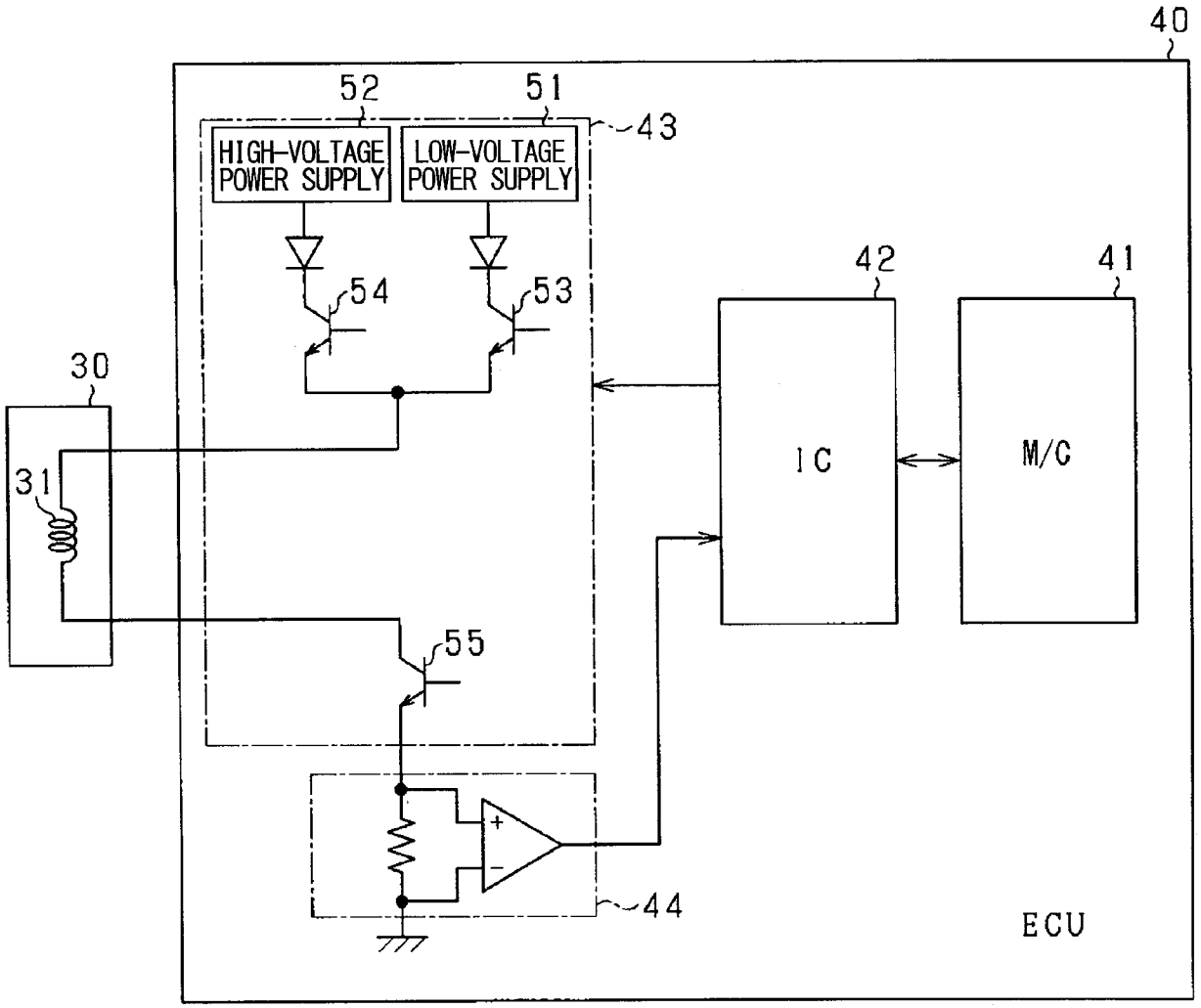
FIG. 2 is a block diagram illustrating a configuration of ECU.

As illustrated in FIG. 2, the ECU 40 includes a microcomputer 41 for engine control, a drive IC 42 for injector drive, an energization operation section 43, and a current detection section 44. The microcomputer 41 calculates a required injection amount depending on the engine operation state (for example, engine speed or engine load), and generates an injection pulse from injection time calculated based on the required injection amount and outputs the injection pulse. The drive IC 42 and the energization operation section 43 correspond to "injector drive section" and "voltage switching section", respectively, and drive the fuel injector 30 with the injection pulse to open a valve for injection of fuel corresponding to the required injection amount.

The energization operation section 43 specifically includes a low-voltage power supply section 51 and a high-voltage power supply section 52, and includes switching elements 53 to 55 that supply a drive current from one of the power supply sections 51, 52 to a coil 31 of the fuel injector 30. In such a case, the low-voltage power supply section 51 includes a low-voltage output circuit that outputs a low voltage V1 of, for example, 12 V. The high-voltage power supply section 52 includes a high-voltage output circuit that outputs a high voltage V2 (boosted voltage) of, for example, 60 to 65 V. The high-voltage power supply section 52 has a boosting circuit that boosts a battery voltage. When the switching elements 53 and 55 are turned on, the low voltage V1 is applied to the coil 31. When the switching elements 54 and 55 are turned on, the high voltage V2 is applied to the coil 31.

While the fuel injector 30 is driven to open a valve with the injection pulse, the low voltage V1 and the high voltage V2 are applied to the coil 31 of the fuel injector 30 while being switched on a time-series basis. In such a case, the high voltage V2 is applied early in valve opening to provide certain valve opening responsivity of the fuel injector 30, and the low voltage V1 is subsequently applied to maintain the valve opening state of the fuel injector 30.

Figure 3A:
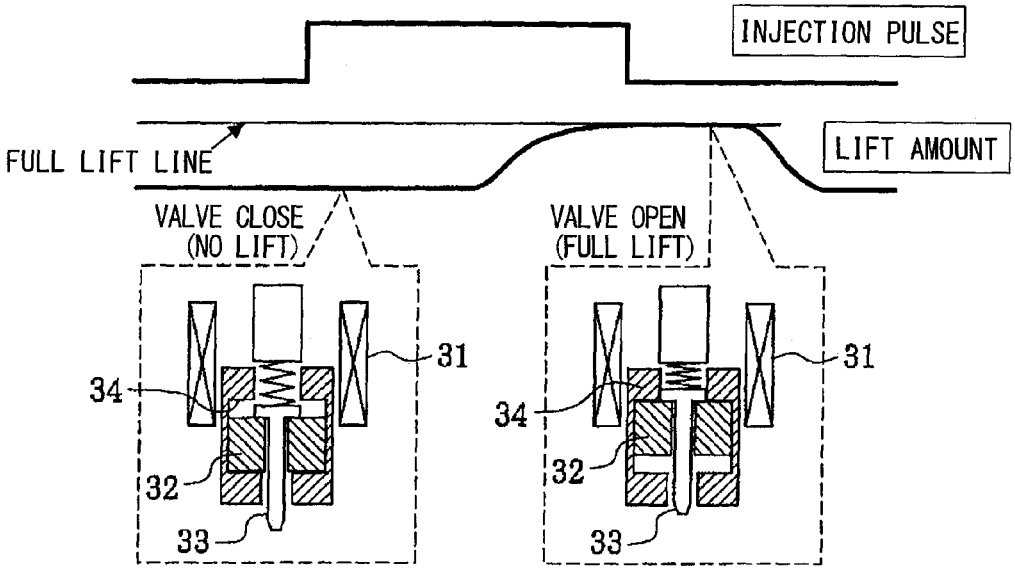
FIG. 3A is a diagram illustrating a configuration and a state of a fuel injector.

In the first embodiment, partial lift injection is performed as a drive mode of the fuel injector 30, in which lift of a needle of the fuel injector 30 is finished in a partial lift state of the needle before arriving at a full lift position, and a desired amount of fuel is injected in that state. Such partial lift injection is briefly described with FIGS. 3A, 3B. FIG. 3A illustrates operation during full lift injection, and FIG. 3B illustrates operation during partial lift injection.

Figure 3B:
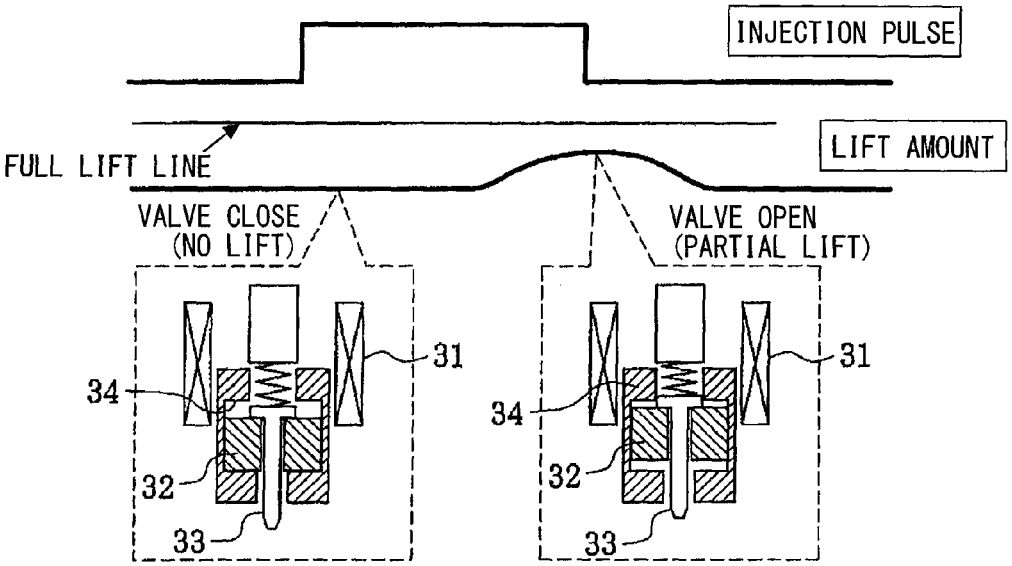
FIG. 3B is a diagram illustrating a configuration and a state of a fuel injector.

As illustrated in FIGS. 3A, 3B, the fuel injector 30 includes the coil 31 that is energized to generate electromagnetic force, and a needle 33 that is moved with a plunger 32 (movable core) by the electromagnetic force. When the needle 33 is moved to a valve opening position, the fuel injector 30 becomes into a valve opening state, and fuel injection is performed. Time (energization period) of the injection pulse is different between FIG. 3A and FIG. 3B. When injection pulse width is relatively long (i.e., needle lift amount is the full lift amount) as illustrated in FIG. 3A, the needle 33 arrives at the full lift position (at which the plunger 32 abuts on a stopper 34). When injection pulse width is relatively short (i.e., needle lift amount is the partial lift amount) as illustrated in FIG. 3B, the needle 33 is in the partial lift state in which the needle 33 does not arrive at the full lift position (a state shortly before the plunger 32 abuts on the stopper 34). When energization of the coil 31 is stopped with falling of the injection pulse, the plunger 32 and the needle 33 return to a valve closing position and thus the fuel injector 30 becomes into a valve closing state, and fuel injection is stopped.

Return to FIG. 2, the current detection section 44 detects the energizing current to the coil 31 during valve-opening drive of the fuel injector 30, and such detection results are sequentially sent to the drive IC 42. The current detection section 44 may have a known configuration, for example, includes a shunt resistance and an amplifier circuit. The current detection section 44 corresponds to "current detection section".

Figure 4:
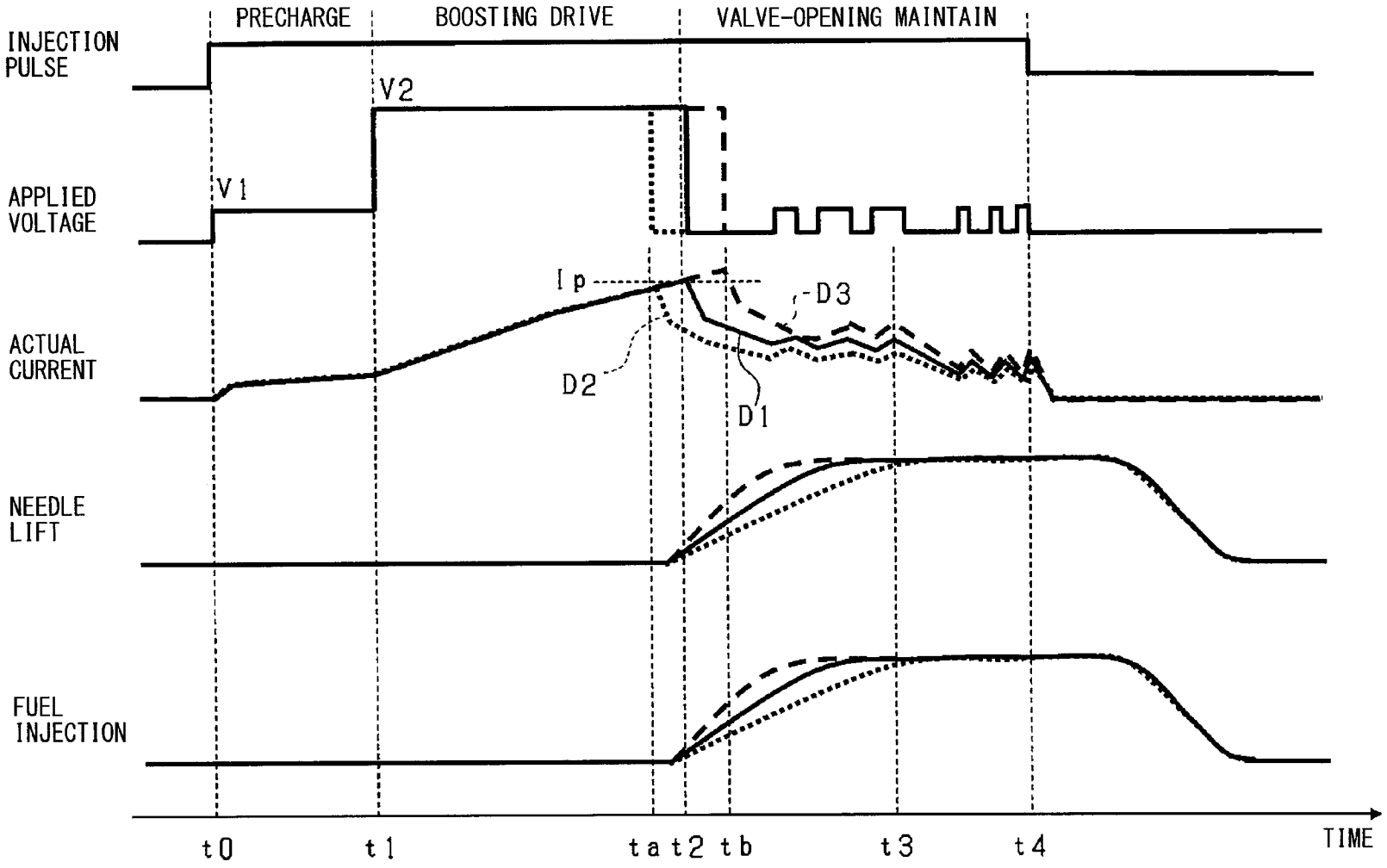
FIG. 4 is a time chart for explaining drive operation of the fuel injector.

Drive operation of the fuel injector 30, which is performed based on the injection pulse by the drive IC 42 and the energization operation section 43, is now described in detail with FIG. 4. In the first embodiment, pre-charge, boosting drive, and valve-opening maintenance drive are performed on a time-series basis in a period where injection pulse is on. In the pre-charge, the low voltage V1 is applied to the coil 31 prior to application of the high voltage V2 at start of energization of the fuel injector 30. Performing the pre-charge reduces arrival time of the coil current to a target peak value. The boosting drive is performed to improve valve-opening responsivity, in which the high voltage V2 is applied to the coil 31 in a boosting drive period. The valve-opening maintenance drive is performed following the boosting drive, in which the low voltage V1 is applied to the coil 31. Basic operation of the fuel injection is now described based on transition shown by a solid line in FIG. 4.

In FIG. 4, the injection pulse is turned on at time t0, and pre-charge is performed with the low voltage V1 from t0 to t1. The pre-charge period should be a beforehand determined time. In the pre-charge period, the pre-charge may be performed through repeatedly turning on and off the switching element 53 with a predetermined duty ratio.

At time t1, the voltage applied to the coil 31 is switched from the low voltage V1 to the high voltage V2. Consequently, the coil current is abruptly increased, and is thus larger in the boosting period from t1 to t2 than in the period from t0 to t1. Subsequently, at time t2, when the coil current arrives at the beforehand determined target peak value Ip, application of the high voltage V2 is stopped. Needle lift is started at the timing when the coil current arrives at the target peak value Ip or at the timing immediately before such timing, and fuel injection is started with the needle lift. Whether the coil current arrives at the target peak value Ip is determined based on the detection current detected by the current detection section 44. Specifically, in the boosting period (t1 to t2), whether the detection current is equal to or larger than Ip in the drive IC 42 is determined, and the energization operation section 43 performs switching of the coil-applied voltage (stop of application of V2) at a point where the detection current becomes larger than or equal to Ip.

After time t2, the coil current is decreased after stop of application of V2, and the low voltage V1 is intermittently applied to the coil 31 based on a beforehand determined current threshold and the detection current detected by the current detection section 44. In FIG. 4, the current threshold is determined in two stages, and every time the coil current (detection current) is lower than or equal to the threshold, the low voltage V1 is applied. Switching of the current threshold (switching from high to low) should be performed at the timing when the needle lift is estimated to correspond to a predetermined partial lift amount (time t3 in FIG. 4).

Subsequently, when the injection pulse is turned off at time t4, current application to the coil 31 is stopped, and the coil current decreases to zero. The needle lift is finished with stop of energization of the coil, and the fuel injection is correspondingly stopped.

For valve-opening drive of the fuel injector 30, although the applied voltage is switched based on the detection result of the coil current as described above, the current detection section 44 may probably detect the current with an error caused by various factors. For example, a detection error probably occurs due to individual difference of the shunt resistance or aged deterioration. In such a case, if an error is contained in the detection current with respect to an actual coil current (actual current), the timing at which the coil current arrives at the target peak value Ip cannot be appropriately grasped, which concernedly results in excess and deficiency of the fuel injection amount.

Specifically, in FIG. 4, if the timing at which the coil current arrives at the target peak value Ip cannot be appropriately grasped, a coil current waveform is shifted with respect to a normal coil current waveform D1 as shown by a broken line D2 or D3. In such a case, if it is recognized that the coil current arrives at Ip at time to earlier than the original Ip arrival timing (time t2) as in the current waveform D2, application stop timing of the high voltage V2 (finish timing of boosting drive) is advanced. This situation appears when the detection current shifts to a larger side with respect to the actual current. Hence, boosting energy in the boosting drive period is decreased and thus needle lift operation is decelerated; hence, the fuel injection amount becomes excessively small.

If it is recognized that the coil current arrives at the Ip at time tb later than the original Ip arrival timing (time t2) as in the current waveform D3, application stop timing of the high voltage V2 (finish timing of boosting drive) is retarded. This situation appears when the detection current shifts to a smaller side with respect to the actual current. Hence, boosting energy in the boosting drive period becomes excessive and thus needle lift operation is accelerated; hence, the fuel injection amount becomes excessively large.

In the first embodiment, therefore, while the high voltage V2 is applied to the fuel injector 30 (i.e., during the boosting drive period), a slope of change in current is calculated for the detection current, and correction processing for correcting the peak point of an actual current through the fuel injector 30 is performed based on the slope of change in current. This suppresses deviation (excess and deficiency) of input energy to the fuel injector 30 when detection error occurs in the coil current.

More specifically, while the high voltage V2 is applied to the fuel injector 30, a point (X1) at which the detection current arrives at the target peak value Ip and a point (X2) at which the detection current arrives at a predetermined intermediate value Ih smaller than the target peak value Ip are defined as current determination points, and a current slope SL is calculated based on current values at the determination points X1 and X2 and a time interval between the determination points. The target peak value Ip is corrected based on the current slope SL.

The microcomputer 41 of the ECU 40 notifies the drive IC 42 of the beforehand determined target peak value Ip and the intermediate value Ih. The drive IC 42 measures peak current arrival time Tp corresponding to time before the detection current arrives at the target peak value Ip in the boosting drive period, and intermediate-current arrival time Th corresponding to time before the detection current arrives at the intermediate value Ih, and notifies the microcomputer 41 of such Tp and Th. The arrival time Tp and the arrival time Th should each be measured as elapsed time from turn-on of the injection pulse. The microcomputer 41 calculates the current slope SL based on the target peak value Ip, the intermediate value Ih, the arrival time Tp, and the arrival time Th, and calculates a peak current correction value Kpe using the current slope SL. The microcomputer 41 corrects the target peak value Ip with the peak current correction value Kpe, and notifies the drive IC 42 of the corrected target peak value Ip.

Figure 5:
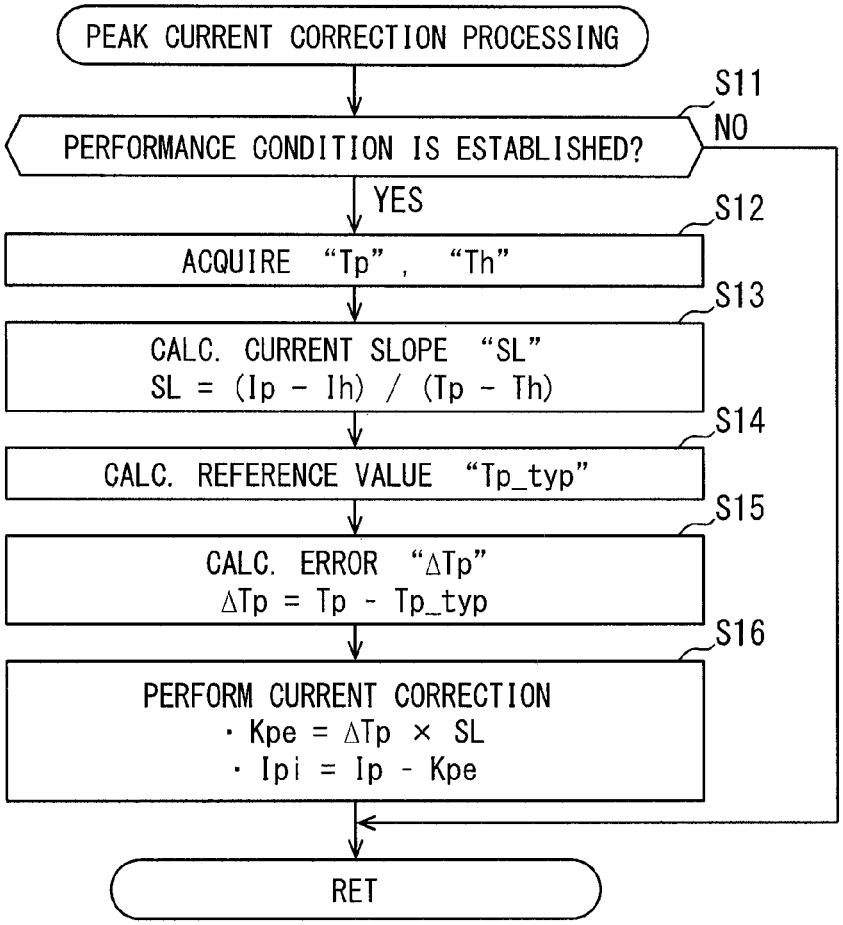
FIG. 5 is a flowchart illustrating a procedure of peak current correction processing.

FIG. 5 is a flowchart illustrating a procedure of peak current correction processing. This processing is repeatedly performed with a predetermined period by the microcomputer 41.

In FIG. 5, whether a performance condition for performing the peak current correction is established is determined in step S11. The performance condition includes a condition that the peak current arrival time Tp and the intermediate-current arrival time Th have been calculated, and a condition that peak current correction is still not performed in vehicle traveling at that time. When all of such conditions are satisfied, the performance condition is determined to be established. The performance condition may also include a condition that an engine operation state is a steady state or a predetermined state other than an idling state (i.e., not a little injection state).

Subsequently, the peak current arrival time Tp and the intermediate-current arrival time Th are acquired in step S12. In subsequent step S13, a slope of change in coil current detection value (current slope SL) is calculated using Formula (1).

$$SL=(Ip-Ih)/(Tp-Th) \quad (1)$$

Figure 6:
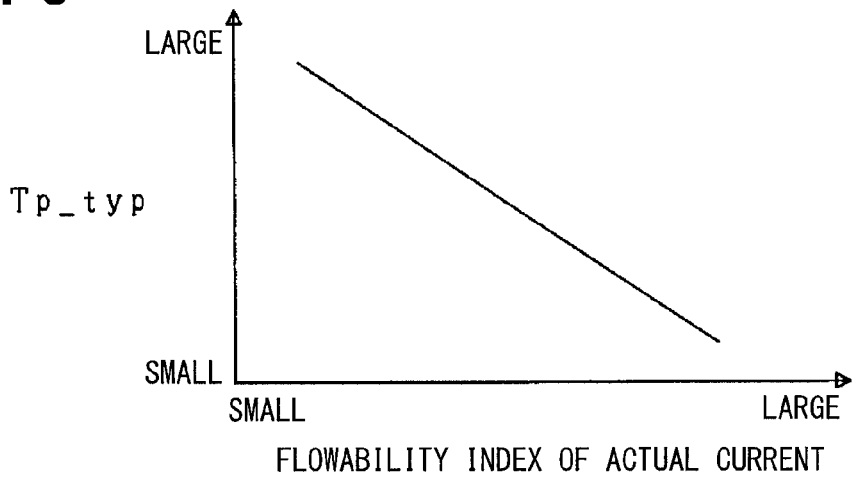
FIG. 6 is a diagram illustrating a relationship between a flowability index of an actual current and a reference value Tp_typ.

Subsequently, a reference value Tp_typ for the peak current arrival time is calculated in step S14. The reference value Tp_typ should be calculated using a relationship of FIG. 6, for example. FIG. 6 defines a relationship between a flowability index of actual current and the reference value Tp_typ, in which the reference value Tp_typ is set to a smaller value in a situation where actual current flows more easily. The flowability index of actual current is determined based on influence of temperature of the fuel injector 30 (coil 31) or influence of the voltage applied to the fuel injector 30. The processing may be designed such that a plurality of characteristic lines are set for each of variation factors of the reference value Tp_typ.

Subsequently, an error ΔTp in the peak current arrival time is calculated using Formula (2) in step S15.

$$\Delta Tp=Tp-Tp_typ \quad (2)$$

In step S16, the peak current correction value Kpe and the corrected target peak value Ipi are calculated using Formulas (3) and (4), respectively.

$$Kpe=\Delta Tp\times SL \quad (3)$$

$$Ipi=Ip-Kpe \quad (4)$$

The peak current correction value Kpe and the corrected target peak value Ipi calculated in step S16 may be appropriately stored as learning values in a backup memory (such as EEPROM). The drive IC 42 is newly notified of the corrected target peak value Ipi.

Figure 7:
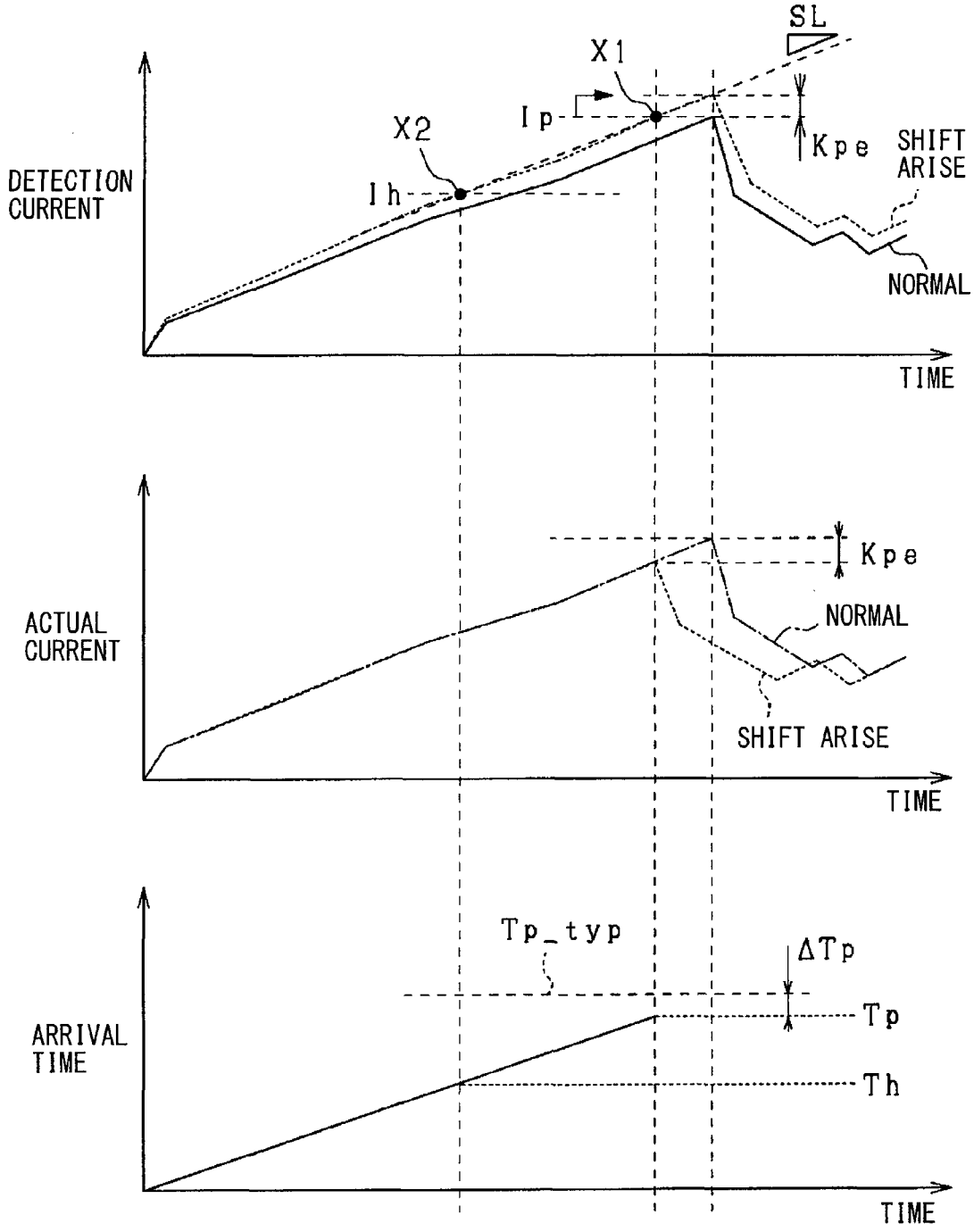
FIG. 7 is a time chart for specifically explaining peak current correction.
Figure 8:
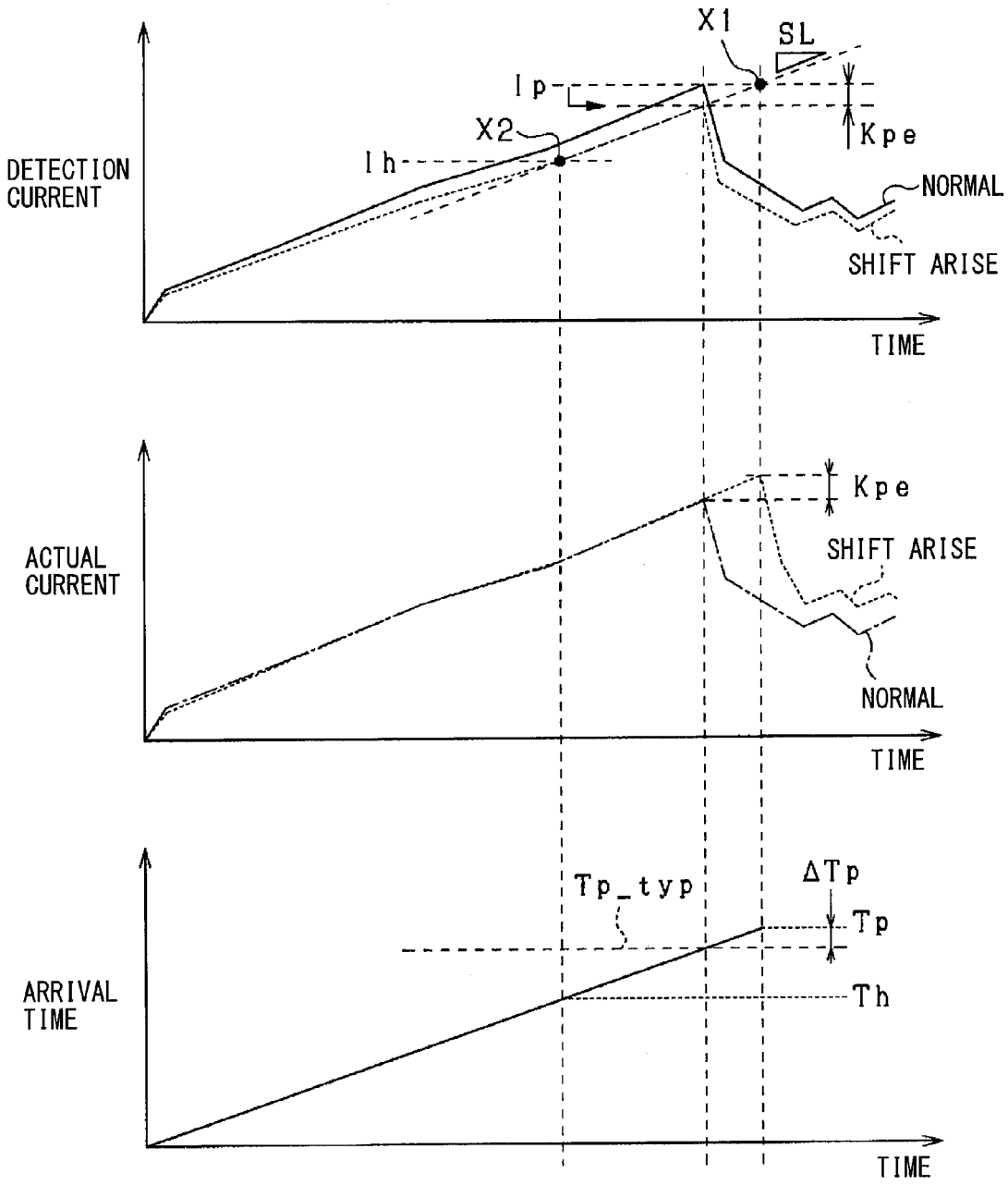
FIG. 8 is a time chart for specifically explaining peak current correction.

An execution example of the above-described processing is now described with reference to FIGS. 7 and 8. FIG. 7 illustrates an example when the detection current detected by the current detection section 44 shifts to a side of a larger detection current. FIG. 8 illustrates an example when the detection current detected by the current detection section 44 shifts to a side of a smaller detection current. With a detection current waveform, a solid line shows a waveform in a normal state, and a broken line shows a waveform in the case where deviation in detection occurs. In FIGS. 7 and 8, pre-charge time is not shown for simplification of description.

In FIG. 7, the intermediate-current arrival time Th at which the detection current arrives at the intermediate value Ih (X2) and the peak current arrival time Tp at which the detection current arrives at the target peak value Ip (X1) in the drive IC 42 are measured for coil energization. The current slope SL is calculated by the Formula (1). The error ΔTp in the peak current arrival time is calculated by the Formula (2), and the peak current correction value Kpe is calculated by the Formula (3). The target peak value Ip is corrected to an increase side by the peak current correction value Kpe.

The target peak value Ip is thus corrected to be increased, which suppresses peak shift in an actual current. It is therefore suppressed that the fuel injection amount disadvantageously becomes excessively small due to shift of the detection current to a larger side with respect to the actual current. Specifically, the increasing correction of the target peak value Ip cancels the deficiency of boosting energy in the boosting drive period, and thus improves valve-opening responsivity of needle lift. This makes it possible to suppress deficiency of the fuel injection amount.

FIG. 8 is different from FIG. 7 in that the target peak value Ip is corrected to a decrease side by the peak current correction value Kpe. The target peak value Ip is thus corrected to be decreased, which also suppresses peak shift in an actual current. It is therefore suppressed that the fuel injection amount disadvantageously becomes excessive due to shift of the detection current to a smaller side with respect to the actual current. Specifically, the decreasing correction of the target peak value Ip cancels the excess of boosting energy in the boosting drive period, and thus reduces valve-opening responsivity of needle lift. This makes it possible to suppress excess of the fuel injection amount.

Accordingly, the following excellent effects can be exhibited.

When an error is contained in the detection current detected by the current detection section 44, the peak point of the actual current through the fuel injector 30 is shifted at application of the high voltage to the fuel injector 30. In such a case, since input energy to the fuel injector 30 is shifted, valve-opening response characteristics (valve-opening speed) are varied, which concernedly leads to excess and deficiency of the fuel injection amount. In this regard, it is designed that while the high voltage is applied to the fuel injector 30, a slope of change in detection current is calculated for the detection current, and correction processing for correcting shift of the peak point of the actual current is performed based on the slope of change in current. Consequently, even if an error exists in the detection current, shift of input energy to the fuel injector 30 can be suppressed, leading to improvement in accuracy of fuel injection control.

In particular, although influence of peak shift in the actual current increases in small injection amount, the above-described design promisingly provides an effect of reducing a variation in small injection amount.

It is designed that when the current slope SL is calculated, a point at which the detection current arrives at the target peak value Ip and a point at which the detection current arrives at the intermediate value Ih are defined as current determination points (measurement points) for such calculation. In such a case, the two current determination points can be away from each other as much as possible in the boosting drive period, and thus calculation accuracy of the current slope SL can be improved. Consequently, correction accuracy of the target peak value Ip can be improved.

It is designed that current values (Ip, Ih) at two or more points are determined, and the current slope SL is calculated using the time information (Tp, Th) before the detection current arrives at the respective current values. In such a case, the current slope SL can be easily calculated using a simple mechanism such as a timer. In addition, the reference value Tp_typ for the peak current arrival time is determined, thereby calculation of time error ΔTp and calculation of the peak current correction value Kpe using the time error ΔTp can be simply performed.

In the fuel injector 30, a slope (flowability) of change in actual current is affected by coil temperature, an applied voltage value, or the like. In consideration of this, it is designed that the reference value Tp_typ for the peak current arrival time is variably set. Consequently, the error ΔTp in the peak current arrival time can be correctly calculated, and thus accuracy of peak current correction can be improved.

The disclosure is not limited to the description of the first embodiment, and may be carried out as follows. In the following description, the same configuration as that in the above description is designated by the same numeral, and is not described in detail.

(Second Embodiment)

In the first embodiment, when the current slope SL of the detection current is calculated, the point (X1) at which the detection current arrives at the target peak value Ip and the point (X2) at which the detection current arrives at the intermediate value Ih are defined as the current determination points, and the current slope SL is calculated based on the current values at the determination points X1 and X2 and a time interval between the determination points. This however is modified. Specifically, in the second embodiment, as illustrated in FIG. 9, when the current slope SL of the detection current is calculated, points (X11, X12) at which the detection current arrives at two respective intermediate values Ih1 and Ih2 are defined as the current determination points, and the current slope SL is calculated based on the current values at the determination points X11 and X12 and a time interval between the determination points.

Figure 9:
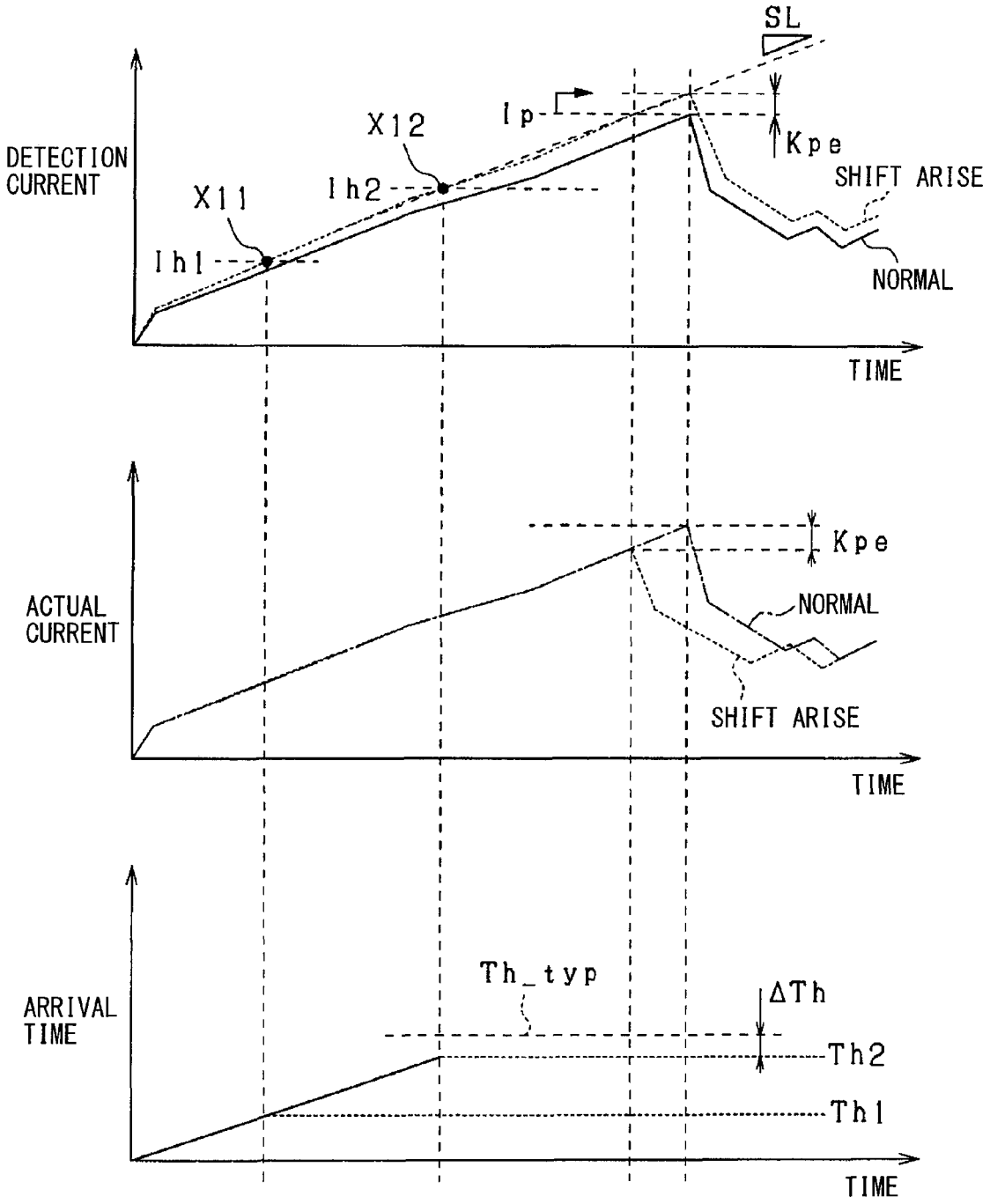
FIG. 9 is a time chart for specifically explaining peak current correction in a second embodiment.

In FIG. 9, the intermediate current arrival time Th1 and the intermediate current arrival time Th2 at which the detection current arrives at the intermediate values Ih1 and Ih2, respectively, in the drive IC 42 are measured for coil energization. The microcomputer 41 calculates the current slope SL by Formula (5), and calculates an error ΔTh in the intermediate-current arrival time by Formula (6).

$$\Delta Th = Th2 - Th_typ \tag{5}$$

$$SL = (Ih2 - Ih1)/(Th2 - Th1) \tag{6}$$

Th_typ in Formula (5) is a reference value for the intermediate-current arrival time, and should be calculated using the relationship of FIG. 6 as with the above-described Tp_typ.

The peak current correction value Kpe is calculated by Formula (7), and the target peak value Ip is corrected with the peak current correction value Kpe.

$$Kpe = \Delta Th \times SL \tag{7}$$

In such a configuration, since the current slope SL is calculated while the points at which the detection current arrives at the respective intermediate values Ih1 and Ih2 are defined as current determination points (measurement points), the current slope SL can be calculated before the coil current arrives at the target peak value Ip in the boosting drive period, and thus the target peak value Ip can be early corrected. That is, the peak value correction can be performed during fuel injection at the same time as calculation of the peak current correction value.

(Third Embodiment)

In the above-described embodiments, processing of correcting the target peak value Ip based on the current slope SL is performed as correction processing. On the other hand, in a third embodiment, processing of modifying a slope of change in increase in actual current in the boosting drive period based on the current slope SL is performed as correction processing. Furthermore, the third embodiment employs a design of calculating a slope error ΔSL from the current slope SL and a beforehand determined reference slope value, a design of modifying the slope of change in increase in actual current based on the slope error ΔSL, and a design of performing pre-charge correction as correction processing.

Figure 10:
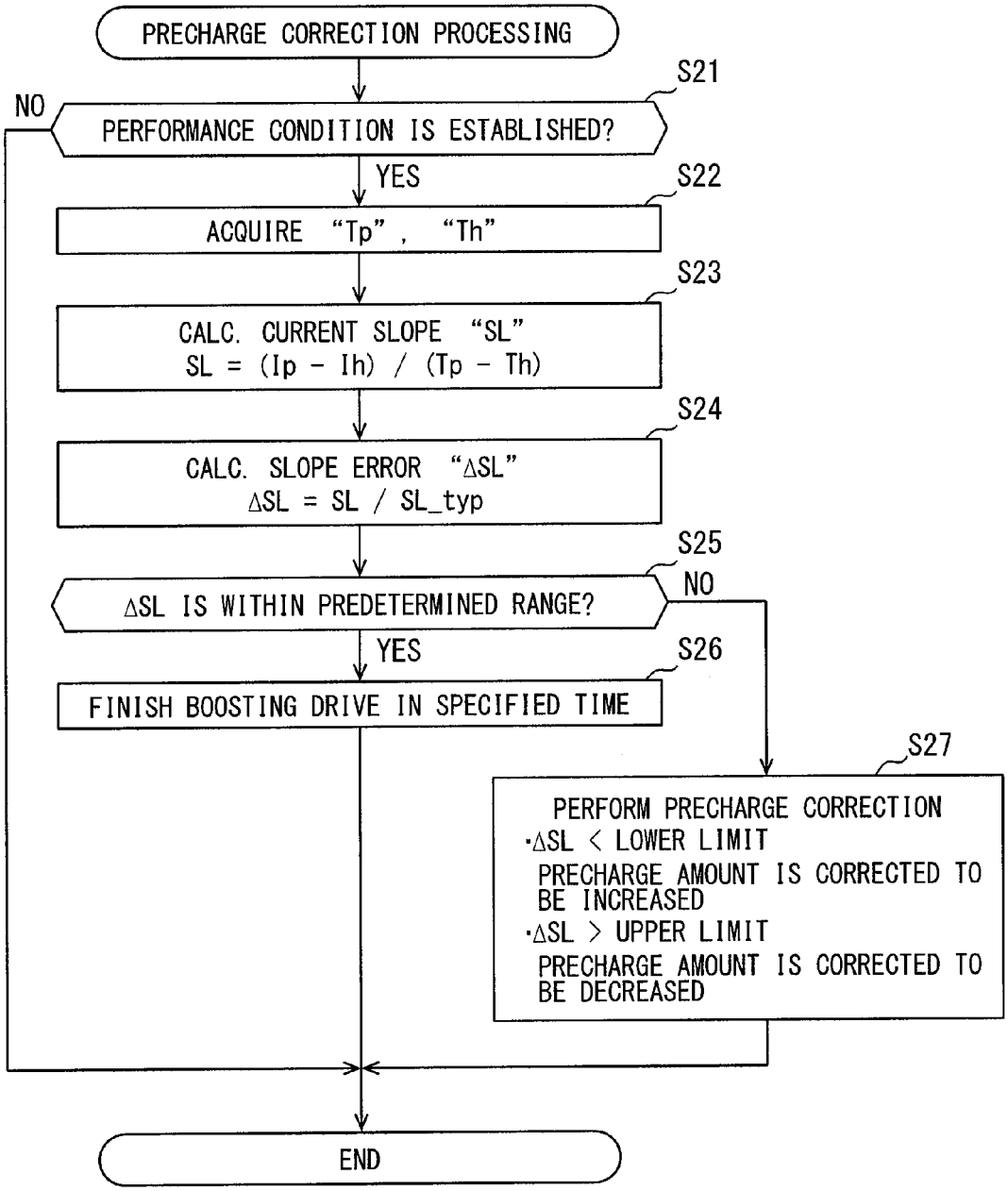
FIG. 10 is a flowchart illustrating a procedure of pre-charge correction processing in a third embodiment.

FIG. 10 is a flowchart illustrating a procedure of pre-charge correction processing. This processing is repeatedly performed with a predetermined period by the microcomputer 41.

In FIG. 10, whether a performance condition for performing the pre-charge correction is established is determined in step S21. The performance condition includes a condition that the peak current arrival time Tp and the intermediate-current arrival time Th have been calculated, and a condition that peak current correction is still not performed in vehicle traveling at that time. When all of such conditions are satisfied, the performance condition is determined to be satisfied. The performance condition may also include a condition that an engine operation state is a steady state or a predetermined state other than an idling state (i.e., not a little injection state).

Subsequently, the peak current arrival time Tp and the intermediate-current arrival time Th are acquired in step S22. In subsequent step S23, the current slope SL is calculated using the Formula (1).

Subsequently, the slope error ΔSL in the detection current is calculated using Formula (8) in step S24. SL_typ is a reference value for the current slope SL.

$$\Delta SL = SL/SL_typ \tag{8}$$

The reference value SL_typ should be calculated based on the flowability index of actual current as with the reference value Tp_typ. In such a case, the reference value for the current slope, SL_typ, should be increased (i.e., the slope should be increased) in a situation where the actual current flows more easily.

Subsequently, whether the slope error ΔSL in the detection current is within a predetermined range defined for appropriate determination on the slope is determined in step S25. If the slope error ΔSL is within the predetermined range, the process is advanced to step S26. In step S26, it is determined that boosting drive is finished in a beforehand determined, specified time. This corresponds to normal processing.

If the slope error ΔSL is not within the predetermined range, the process is advanced to step S27. In step S27, pre-charge correction is performed. In this case, if the slope error ΔSL is out of the predetermined range and less than a lower limit, the pre-charge amount is corrected to be increased so that input energy is increased in the pre-charge period. If the slope error ΔSL is out of the predetermined range and larger than an upper limit, the pre-charge amount is corrected to be decreased so that input energy is decreased in the pre-charge period. The increasing correction and decreasing correction of the pre-charge amount should be achieved by at least one of increasing/decreasing a pre-charge current and lengthening/reducing the pre-charge period. When the pre-charge period is lengthened or reduced, width of an injection pulse should be varied by a level corresponding to such an increase or decrease of the period.

Figure 11A:
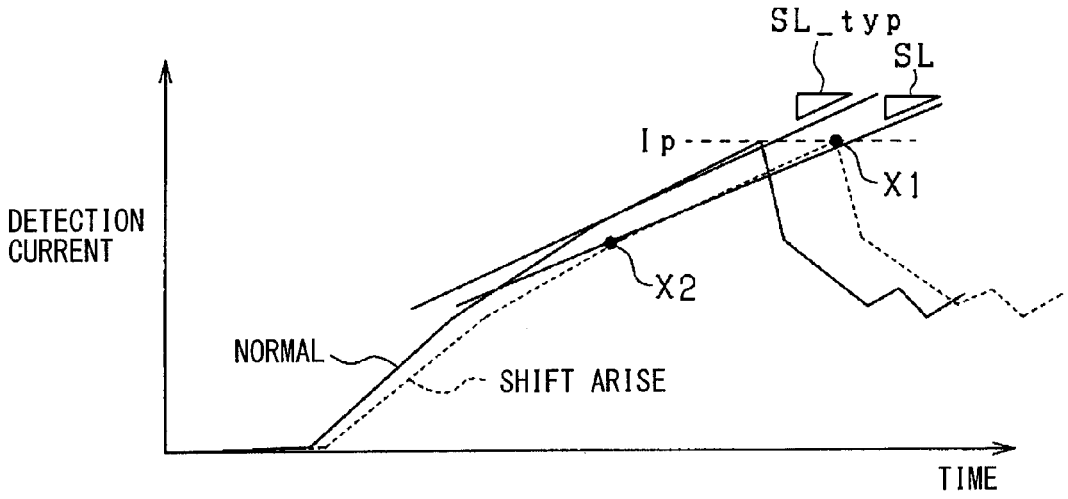
FIG. 11A is a time chart for specifically explaining pre-charge correction in the third embodiment.
Figure 11B:
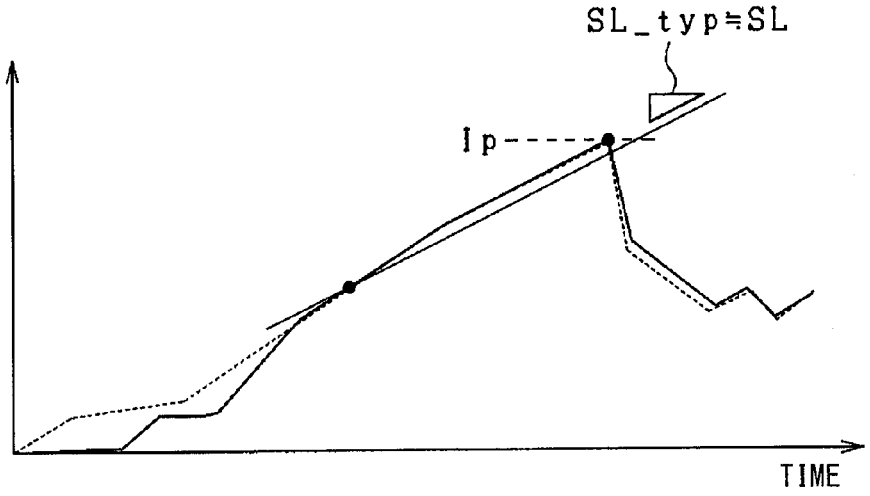
FIG. 11B is a time chart for specifically explaining pre-charge correction in the third embodiment.

An execution example of the above-described processing is now described with reference to FIGS. 11A, 11B. FIGS. 11A, 11B illustrate an example when the detection current detected by the current detection section 44 shifts to a side of a smaller detection current. With a detection current waveform, a solid line shows a waveform in a normal state, and a broken line shows a waveform in the case where deviation in detection occurs.

As illustrated in FIG. 11A, when the detection current is normal, the current slope corresponds to the reference value SL_typ. On the other hand, when the detection current is shifted, the current slope is smaller than the reference value SL_typ. In such a case, pre-charge correction is performed based on the slope error ΔSL (=SL/SL_typ). Consequently, as illustrated in FIG. 11B, the current slope SL of the detection current corresponds to the reference value SL_typ.

The pre-charge correction is thus performed, thereby peak shift in the actual current is suppressed. It is therefore suppressed that the fuel injection amount disadvantageously becomes excessive due to shift of the detection current to a smaller side with respect to the actual current.

If the amount of input energy varies during pre-charge drive, a slope of change in increase in the actual current varies during boosting drive. It is designed that the amount of input energy given by the pre-charge is corrected using such a slope variation, thereby the slope of change in increase in the actual current is adjusted. This also makes it possible to improve accuracy of fuel injection control.

(Other Embodiments)

In the first embodiment, the measurement points for calculating the current slope SL are defined to be the point (X1) at which the detection current arrives at the target peak value Ip and the point (X2) at which the detection current arrives at the intermediate value Ih. In the second embodiment, the measurement points for calculating the current slope SL are defined to be the points (X11, X12) at which the detection current arrives at the two respective intermediate values Ih1 and Ih2. Such measurement points may be combined to form a configuration including three or more measurement points. Specifically, the following configuration may be used: The point at which the detection current arrives at the target peak value Ip and the points at which the detection current arrives at two or more intermediate values are defined as measurement points, and the current slope SL is calculated based on current values at such measurement points and time intervals between the points.

A drive method of the fuel injector 30 may not include pre-charge. In such a case, for example, in the third embodiment, processing of correcting the high voltage V2 by the high-voltage power supply section 52 should be performed as processing of modifying the slope of change in increase in the actual current in place of the processing of correcting the amount of input energy given by pre-charge.

The high-voltage power supply section 52 outputting the high voltage V2 may not have a boosting circuit boosting the battery voltage, but may include a high-voltage battery.

The peak shift correction section for correcting peak shift in the actual current may be designed to have both a peak current correction section and a pre-charge correction section. In such a case, both of a peak current correction value calculated by the peak shift correction section and a pre-charge correction value calculated by the pre-charge correction section may be used, or one of the two correction values may be preferentially used. It is also acceptable that a performance condition of the peak current correction and a performance condition of the pre-charge correction are individually determined, and correction processing is alternatively performed based on whether either performance condition is established.

The invention claimed is:

1. A fuel injection control device for an internal combustion engine, the fuel injection control device being used in an internal combustion engine having a fuel injector that is driven to open a valve through energization, the fuel injection control device comprising an injector drive section that, for a fuel injection by the fuel injector, applies a predetermined high voltage for valve-opening operation and subsequently applies a predetermined low voltage to maintain valve-opening, and thus energizes the fuel injector, the fuel injection control device further comprising:

a current detection section that detects an energizing current flowing through the fuel injector;

a voltage switching section that, after start of an energization of the fuel injector, when a detection current detected by the current detection section arrives at a beforehand determined target peak value, switches the voltage applied to the fuel injector from the high voltage to the low voltage; and a peak shift correction section that calculates a slope of change in current for the detection current while the high voltage is applied to the fuel injector, and performs correction processing to correct shift of a peak point of an actual current flowing through the fuel injector based on the slope of change in current.

2. The fuel injection control device for an internal combustion engine according to claim 1, wherein the peak shift correction section includes:

a slope calculation section that, while the high voltage is applied to the fuel injector, calculates the slope of change in current based on current values of the fuel injector at two or more measurement points and a time interval between the measurement points; and a peak correction section that corrects, as the correction processing, the target peak value based on the slope of change in current calculated by the slope calculation section, wherein the slope calculation section defines, as the measurement points, a point at which a detection current detected by the current detection section arrives at the target peak value and a point at which the detection current detected by the current detection section arrives at a predetermined intermediate value smaller than the target peak value, and calculates the slope of change in current.

3. The fuel injection control device for an internal combustion engine according to claim 1, wherein the peak shift correction section includes:

a slope calculation section that, while the high voltage is applied to the fuel injector, calculates the slope of change in current based on current values of the fuel injector at two or more measurement points and a time interval between the measurement points; and a peak correction section that corrects, as the correction processing, the target peak value based on the slope of change in current calculated by the slope calculation section, wherein the slope calculation section defines, as the measurement points, points at which the detection current detected by the current detection section arrives at two or more predetermined intermediate values smaller than the target peak value, and calculates the slope of change in current.

4. The fuel injection control device for an internal combustion engine according to claim 2, wherein the peak shift correction section includes:

a time deviation calculation section that calculates a time error from actual measured values of the time interval between the measurement points and a beforehand determined reference time; and a correction value calculation section that calculates a correction value to correct the target peak value based on a product of the slope of change in current and the time error.

5. The fuel injection control device for an internal combustion engine according to claim 4, further comprising:

a section that variably sets the reference time depending on a level of flowability of an actual current through the fuel injector.

6. The fuel injection control device for an internal combustion engine according to claim 1, wherein the peak shift correction section includes:

a slope error calculation section that calculates a slope error from the slope of change in current and a beforehand determined reference slope value; and a slope correction section that performs, as the correction processing, processing of modifying, based on the slope error, a slope of change in increase in the actual current while the high voltage is applied to the fuel injector.

7. The fuel injection control device for an internal combustion engine according to claim 6, further comprising:

a section that variably sets the reference slope value depending on a level of flowability of an actual current through the fuel injector.

8. The fuel injection control device for an internal combustion engine according to claim 1, wherein the injector drive section performs a pre-charge through application of the low voltage prior to application of the high voltage at start of an energization of the fuel injector, and the peak shift correction section corrects the amount of input energy given by the pre-charge based on the slope of change in current.

* * * * *